US006212848B1

(12) United States Patent
Cooper

(10) Patent No.: US 6,212,848 B1
(45) Date of Patent: Apr. 10, 2001

(54) CONSTRUCTION CHAIR WITH PLASTIC BASE

(76) Inventor: Henry R. Cooper, 5302 Spencer Hwy., Pasadena, TX (US) 77505

( * ) Notice: Subject to any disclaimer, the term of this patent is extended or adjusted under 35 U.S.C. 154(b) by 0 days.

(21) Appl. No.: 09/436,426

(22) Filed: Nov. 9, 1999

Related U.S. Application Data

(60) Provisional application No. 60/109,459, filed on Nov. 23, 1998.

(51) Int. Cl.[7] ..... E04C 5/16

(52) U.S. Cl. ..... 52/684; 52/677; 52/689; 404/135; 404/136

(58) Field of Search ..... 52/677, 684, 685, 52/686, 687, 688, 689, 719; 404/135, 136

(56) References Cited

U.S. PATENT DOCUMENTS

| | | | | |
|---|---|---|---|---|
| 2,191,979 | * | 2/1940 | Bierbach | 52/677 X |
| 2,257,421 | * | 9/1941 | Mabry | 52/689 X |
| 3,289,379 | * | 12/1966 | Watts | 52/689 |
| 3,360,898 | * | 1/1968 | Beckman | 52/684 |
| 3,378,981 | | 4/1968 | Horne . | |
| 3,736,719 | | 6/1973 | Wise . | |
| 4,060,954 | | 12/1977 | Liuzza . | |
| 4,110,951 | | 9/1978 | Padrun . | |
| 4,483,119 | | 11/1984 | Hernandez . | |
| 4,498,270 | | 2/1985 | Ilukowicz . | |
| 4,655,023 | * | 4/1987 | Yung | 52/685 |
| 4,835,933 | | 6/1989 | Yung . | |
| 5,107,654 | | 4/1992 | Leonardis . | |
| 5,590,503 | * | 1/1997 | Spronken | 52/677 |

* cited by examiner

*Primary Examiner*—Carl D. Friedman
*Assistant Examiner*—Kevin D. Wilkens
(74) *Attorney, Agent, or Firm*—Harrison & Egbert

(57) ABSTRACT

A support device for use in tilt-wall construction including a support body having at least two support legs and a bottom extending between the support legs, and a base formed of a polymeric material. The base is affixed to the bottom of the support body. The base has a plurality of legs extending outwardly therefrom. The support body is of a generally U-shaped or L-shaped cross-section. The support body is formed of a single piece of a metal material. The support legs each have a slot formed adjacent an edge opposite the bottom. These slots open on opposite sides of the support legs.

15 Claims, 3 Drawing Sheets

FIG. 1
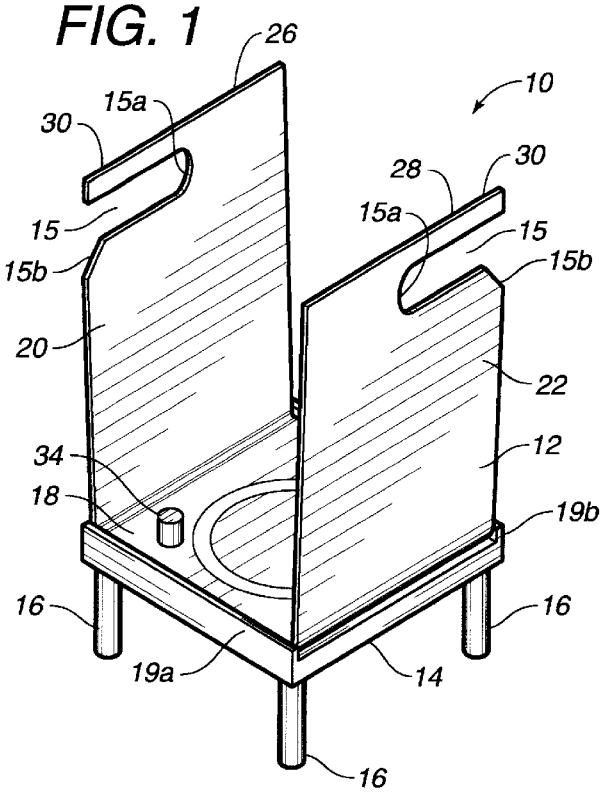
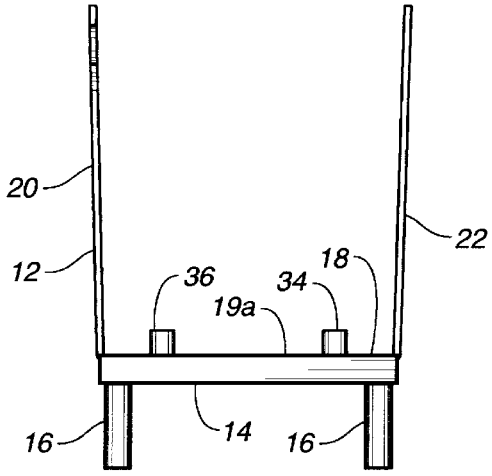
FIG. 2
FIG. 3
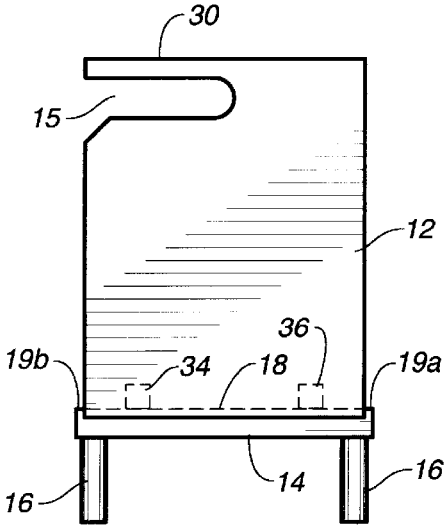
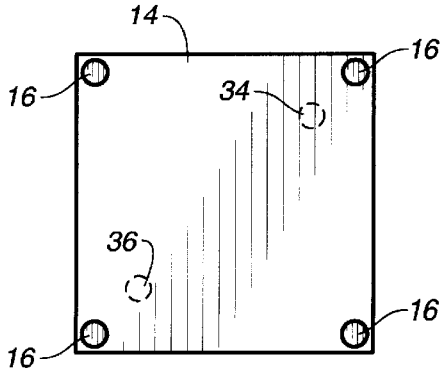
FIG. 4

CONSTRUCTION CHAIR WITH PLASTIC BASE

RELATED APPLICATION

The present utility patent application claims the benefit of earlier filed U.S. Provisional Application Serial No. 60/109,459, filed on Nov. 23, 1998 and entitled "CONSTRUCTION CHAIR WITH PLASTIC BASE",

TECHNICAL FIELD

The present invention relates to construction chairs. More particular, the present invention relates to devices for supporting rebar and mesh a desired distance above an outer surface of a wall used in tilt-wall construction.

BACKGROUND ART

In reinforced concrete construction applications, such as highways, or in floors, or in the walls of buildings, spacer devices, commonly referred to as chairs, are required for supporting and maintaining reinforcing rods or bars which are positioned in the area where the concrete is to be poured. These reinforcing rods are sometimes referred as "rebars". Depending on such parameters as the total surface area and the thickness of the end product of concrete, reinforcement is mandated in varying degrees by building codes. One such method of reinforcement involves a steel mesh, while in major concrete construction, such as highways, and for high-rise buildings, reinforcing rods of various diameters, typically one-half inch or more, are required. In addition, on such jobs, the reinforcing bars may be positioned in spaced layers due to the thickness of the floor, for example. In some installations, a first layer of rebar is provided, with the reinforcing rods or rebars in spaced parallel relation, that is, they are parallel to each other, and generally parallel to the surface on which the concrete is to be poured. A second layer of rebar is then added, with the orientation of the second layer perpendicular to the first layer, thus forming a grid or latticework. After the reinforcing bars or latticework is prepared, the concrete is then poured over this grid or framework, which is ultimately embedded within the highway, floor or wall.

By way of example, for a concrete floor on a prepared surface, spacers or chairs are utilized for providing the vertical separation of the rebar grid from the surface on which the concrete is to be poured. The prepared surface may be a wood or plywood structure or form, or may be a compacted surface, the latter of which may be provided with a layer of compacted sand, with a plastic sheet covering thereon providing a moisture barrier. Spacers or chairs are positioned on the prepared surface for supporting the rebars in a plane generally parallel to the prepared surface.

Such spacers are also utilized in forming walls, such as in the construction of buildings referred to as concrete tilt-up structures. With prior art metallic rebar chairs, after the wall is poured and sets, all spacer or chair locations are checked for exposure of any portion of the chair at the surface of the wall. All of such exposed metallic edges are ground and then sealed to protect from the formation of rust, which attacks the metal of the rebar or chair on the interior of the wall, causing structural weaknesses. In addition, in tilt-wall constructions, the metal from the chair can rust and eventually bleed into the concrete at the outer wall. This can create an unsightly and unprofessional appearance of the concrete structure. As such, a need has developed so as to protect such structures from the corroding chairs.

In the past, various U.S. patents have issued relating to such chair constructions. For example, U.S. Pat. No. 3,378,981 describes a chair having a flat base with a U-shaped metallic chair extending upwardly therefrom. The metallic chair has a pair of slots formed on the legs of the chair. The slots serve to receive mesh or rebar therein. The slots are oriented in opposed relationship.

U.S. Pat. No. 4,498,270, issued on Feb. 12, 1985 to R. J. Ilukowicz, describes a support for reinforcing rods or mesh. The support includes a plate of substantially planar construction. A cruciform structure is provided beneath and supporting the plate. The cruciform structure includes a plurality of legs and tips depending from the legs. The tips are adapted to expose a relatively minimal part of the structure with the support being embedded in a substance such as concrete. A structure is provided on the top of the plate to limit movement of the rod or mesh.

U.S. Pat. No. 4,835,933, issued on Jun. 6, 1989 to F. P. Yung, describes a spacer assembly with a body having a base portion with a generally centrally disposed support post portion. A clamp member is provided for simultaneously securing mutually perpendicular rebars to the chair. The clamp member includes a generally U-shaped lower portion. An arrangement of legs extend downwardly from the bottom portion of the spacer assembly so as to support the planar surface base portion thereabove.

It is an object of the present invention to provide a construction chair particularly adapted for use with tilt-wall construction.

It is another object of the present invention to provide a construction chair which minimizes the problem of rust associated with metallic chairs.

It is a further object of the present invention to provide a construction chair which minimizes exposure to the outside surface of the wall associated with tilt-wall construction.

It is still a further object of the present invention to provide a construction chair which is easy to use, easy to manufacture and relatively inexpensive.

These and other objects and advantages of the present invention will become apparent from a reading of the attached specification and appended claims.

SUMMARY OF THE INVENTION

The present invention is a chair having a plastic base which is adapted for use in association with tilt-wall construction. The chair is formed of a metallic material. The chair is U-shaped or L-shaped and is formed from a single sheet of material. Slots are formed on the upper edge of the support legs of the chair. The slots face in opposite directions so as to receive mesh or rebar therein. The bottom of the chair extends between the support legs. The bottom is a generally flat surface. The bottom of the chair includes holes for connecting to the plastic base.

The plastic base is affixed to the bottom of the chair. The plastic base has a generally square configuration with legs extending downwardly therefrom. The plastic base is attached in surface-to-surface contact with the bottom of the chair. Flanges extend upward from a surface of the plastic base on opposite sides of the base. The bottom of the chair is secured between such flanges. The legs extend downwardly from the four corners of the base. Each of the legs has a flat bottom surface. The plastic base has projections which extend upwardly therefrom. These projections are rigidly received in the holes in the bottom of the chair. These projections extend through the holes and upwardly above the bottom of the chair. These projections are arranged on a diagonal extending across the base.

BRIEF DESCRIPTION OF THE DRAWINGS

FIG. 1 is an upper perspective view of the construction chair for receiving mesh in accordance with the preferred embodiment of the present invention.

FIG. 2 is an end view of the construction chair of FIG. 1 in accordance with the present invention.

FIG. 3 is a side elevational view of the construction chair of FIG. 1 in accordance with the present invention.

FIG. 4 is a bottom view of the construction chair in accordance with the present invention.

DETAILED DESCRIPTION OF THE INVENTION

Figure 5:
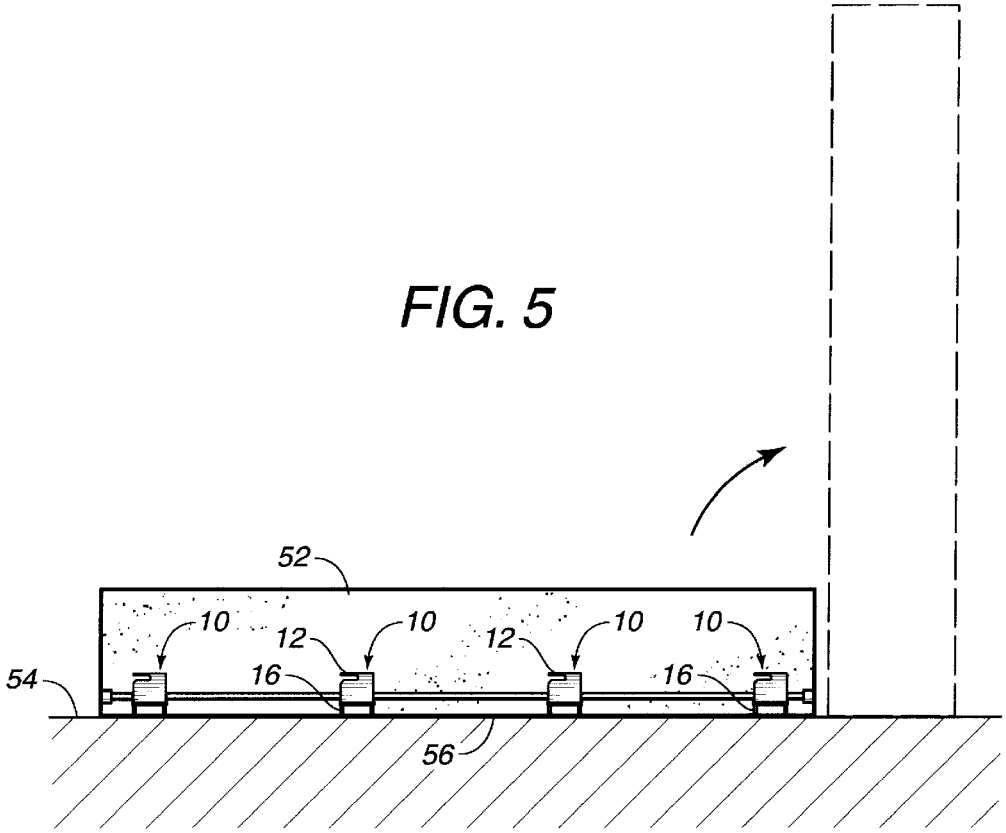
FIG. 5 is a diagrammatic illustration of the use of the construction chair of the present invention in association with tilt-wall construction.

Referring to FIG. 1, there is shown at 10 the construction chair in accordance with the teachings of the present invention. The construction chair 10 is a mesh chair which includes metallic chair 12 and plastic base 14. The plastic base 14 has legs 16 extending downwardly therefrom. The plastic base 14 is secured to the bottom 18 of chair 12.

The chair 12 is substantially U-shaped and is preferably formed of a single strip of metal with the bottom 18 having a generally flat surface and legs 20 and 22 extending vertically upwardly from base 18. It should be noted that the juncture of the flat bottom 18 with the support legs 20 and 22 is preferably curved or rounded to eliminate any sharp edges or projections. It can be appreciated that the metallic chair 12 can be used for supporting wire mesh. It can also be appreciated that the legs 20 and 22 are shown formed integrally with the bottom 18. However, such legs 20 and 22 could also be secured to the bottom 18 by welding or other suitable securing means without departing from the spirit of the invention.

Each of the legs 20 and 22 includes a laterally or horizontally extending notch 15 formed therein for receiving a strand of wire mesh therein. The slots 15 are formed near the upper edge 26 of leg 20 and the upper edge 28 of leg 22. The notches 15 face or open in opposite directions relative to each other. Each of the notches 15 terminates at approximately the lateral midpoint of the support legs 20 and 22 into which they are cut. As such, the notches 15 form a shoulder or stop for engaging and securing a strand of mesh at approximately midway between the opposite edges or sides of the legs 20 and 22. Since each of the notches 15 extends in opposite directions relative to each other, the stops 15*a* are also opposed relative to each other and will therefore engage opposite sides of the strand or mesh extending therethrough.

After the mesh has been inserted laterally into the notches 15, which may be accomplished simply by aligning the mesh with the opposite open ends of such notches 15 and rotating the chair 12 horizontally until the mesh engages the stops 15*a* at the terminal ends of the notches 15. The tabs 30 which are disposed above the notches 15 can be twisted around and under the mesh to thereby grip it or lock it into position adjacent to the stops 15*a* so as to firmly securely the mesh within the chair 12.

The notches 15 are preferably formed with the lower portion 15*b* having tapered or rounded portions adjacent their open ends. The tapered portion 15*b* facilitates the insertion of the wire of the mesh into the notches 15.

In FIG. 1, it can be seen that the base 14 has a projection 34 extending upwardly through a hole in the bottom 18 of the chair 12. The base 14 has legs 16 extending downwardly and outwardly therefrom. The legs 16 occur at each of the four comers of the generally rectangular or square base 14. Each of the legs 16 has a flat bottom. The base 14, along with legs 16, is formed of a polymeric material. The base 14 has flanges 19*a* and 19*b* extending upwardly on opposite sides thereof. The flanges 19*a* and 19*b* secure the bottom 18 of the chair 12 therebetween.

FIG. 2 shows the relationship of the plastic base 14 with the chair 12. In FIG. 2, it can be seen that the support legs 20 and 22 extend vertically upwardly from the bottom 18. Projections 34 and 36 extend through holes in the bottom 18 and upwardly above the top surface of the bottom 18. The projections 34 and 36 serve to securely mount the planar base 14 to the bottom 18 in surface-to-surface contact therewith. Legs 16 are shown as extending downwardly from the base 14. Flange 19*a* extends upwardly above the bottom 18 of chair 12.

In FIG. 3, the chair 12 is shown as having its notch 15 and tab portion 30 extending thereabove. The plastic base 14 has projections 34 and 36 extending upwardly through the bottom 18 of the chair 12. Legs 16 have a flat bottom. Legs 16 extend downwardly from the base 14.

In FIG. 3, it can be seen that the bottom 18 of chair 12 is secured between the flanges 19*a* and 19*b*. These flanges 19*a* and 19*b* assure that the metallic chair 12 is properly secured in relation to the base 14. The flanges 19*a* and 19*b* also serve to guide the holes over the projections 34 and 36.

In FIG. 4, it can be seen that the plastic base 14 has four legs 16 extending downwardly from the four corners of the generally square-shaped base 14. Projections 34 and 36 are illustrated in broken line fashion as extending above the top surface of the plastic base 14.

FIG. 5 shows the manner in which the chairs 10 can be used in tilt-wall construction. As can be seen in FIG. 5, the chairs 10 receive a mesh or rebar 50 therein. The mesh or rebar 50 is suitably anchored within the concrete 52. The slab of concrete 52 is poured with the mesh or rebar 50 residing therein. The slab 52 is formed on the earth 54. Suitable formwork can be applied around the exterior of the slab 52 so as to create the slab 52. As can be seen in FIG. 5, the legs 16 serve to support each of the chairs 10 a desired distance from the exterior wall 56 of slab 52. Since the legs 16 are of a plastic material, they will not corrode, rust, or otherwise bleed into the exterior wall 56. The metallic chair 12 is positioned a suitable distance away from the exterior wall 56 so as to prevent any bleeding from occurring. After the slab 52 is created, it can be tilted upwardly (in the manner shown by the arrow in FIG. 5) so as to reside in a vertical orientation.

Figure 6:
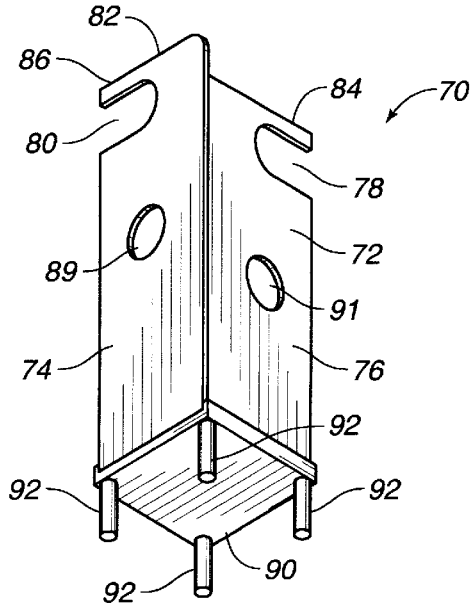
FIG. 6 is an alternative embodiment showing a construction chair for receiving rebars in accordance with the teachings of the present invention.

In FIG. 6, alternative embodiment 70 of the present invention is illustrated. The chair apparatus 70 has a chair portion 72 suitable for the receipt of rebar therein. The chair 72 is formed of metal so as to have sides 74 and 76 extending at a right angle to each other. A notch 78 is formed in side 76 and a notch 80 is formed in side 74 adjacent to the top 82 of the chair 72. A tab 84 is associated with notch 78 and a tab 86 is associated with notch 80. The notches 78 and 80 are suitable for receiving rebar therethrough. The chair apparatus 70 is particularly designed so as to receive rebar that might extend in a lattice form. Holes 89 and 91 are formed on sides 74 and 76, respectively.

In FIG. 6, it can be seen that the plastic base 90 is affixed to the bottom of the chair 72. Plastic base 90 has a configuration similar to that described hereinbefore. The plastic base 90 has legs 92 extending downwardly therefrom. As such, the chair apparatus 70, as illustrated in FIG. 6, can also be used in tilt-wall construction.

Figure 7:
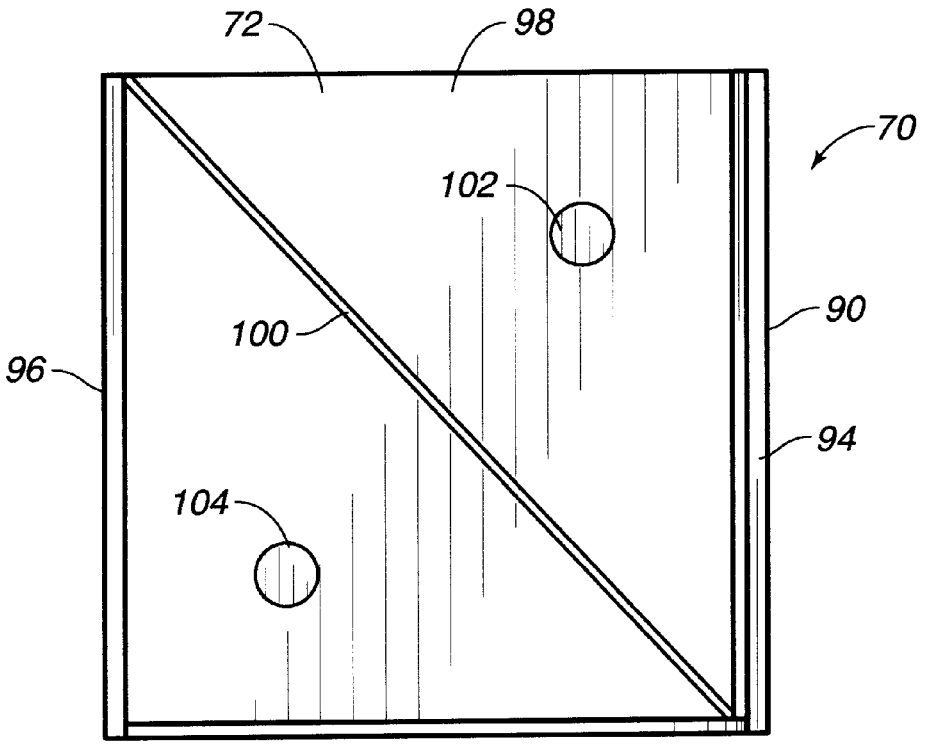
FIG. 7 is a plan view of the alternative embodiment of FIG. 6.

FIG. 7 shows the interior configuration of the chair apparatus 70 in relation to the plastic base 90. Flanges 94 and 96 extend upwardly along opposite sides of the bottom 98 of the chair 72. This serves to secure the chair 72 in a proper position relative to the plastic base 90. A split 100 is formed in the bottom 98 so as to allow the chair 72 to be formed of a unitary construction. The projections 102 and 104 extend through holes formed in the bottom 98. Since the metal chair 72 has a slight memory when formed, the combination of the flanges 94 and 96 with the projections 102 and 104 will cause the split 100 to be maintained in its desired position, will enhance the structural integrity of the chair 72 and will prevent any undesired tilting of the bottom 98 with the respect to the plastic base 90.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A support device for use in tilt-wall construction comprising:

a support body having at least two support legs and a bottom extending between said support legs, said support body having a generally L-shaped cross-section; and a base formed of a polymeric material, said base affixed to said bottom of said support body, said base having a plurality of legs extending outwardly therefrom.

2. The support device of claim 1, said support body being formed of a single piece of a metal material.

3. The support device of claim 1, said bottom being a generally flat surface extending transverse to and between said support legs.

4. A support device for use in tilt-wall construction comprising:

a support body having a first support leg and a second support leg and a bottom extending between said support legs, said first support leg having a slot formed adjacent an edge opposite said bottom, said second support leg having a slot formed adjacent an edge opposite said bottom; and a base formed of a polymeric material, said base affixed to said bottom of said support body, said base having a plurality of legs extending outwardly therefrom.

5. The support device of claim 4, said slot of said first support leg opening on a side of said first support leg, said slot of said second support leg opening on a side of said second support leg opposite to said side of said first support leg.

6. A support device for use in tilt-wall construction comprising:

a support body having at least two support legs and a bottom extending between said support legs; and a base formed of a polymeric material, said base affixed to said bottom of said support body, said base having a plurality of legs extending outwardly therefrom, said base comprising a square base affixed in surface-to-surface contact with said bottom of said support body.

7. The support device of claim 6, said square base having said plurality of legs extending respectively from four corners of said square base.

8. The support device of claim 6, said square base having flanges extending upwardly from respective opposite sides thereof, said bottom of said support body being retained between said flanges.

9. The support device of claim 6, said square base having at least two projections extending outwardly from a side of said square base opposite said plurality of legs, said projections being received within holes formed in said bottom.

10. The support device of claim 9, said at least two projections comprising a first projection and a second projection arranged on a diagonal across said square base.

11. A support device for use in construction comprising:

a support body having at least two support legs and a bottom extending between said support legs, said support body being formed of a single piece of a metal material; and a base integrally formed of a polymeric material, said base affixed to said bottom of said support body, said base having a plurality of legs extending outwardly therefrom opposite said support body, said base having at least two projections extending outwardly from a side of said base opposite said plurality of legs, said projections being received within holes formed in said bottom of said support body, said base having a pair of flanges extending upwardly respectively from opposite sides of said base, said bottom of said support body being retained between said flanges.

12. The support device of claim 11, said at least two support legs comprising a first support leg and a second support leg, said first support leg having a slot formed adjacent an edge opposite said bottom, said second support leg having a slot formed adjacent an edge opposite said bottom, said slot of said first support leg opening on a side of said first support leg, said slot of said second support leg opening on a side of said second support leg opposite said side of said first support leg.

13. The support device of claim 11, said bottom being a generally flat surface extending transverse to and between said support legs.

14. The support device of claim 11, said at least two projections comprising a first projection and a second projection arranged on a diagonal across said base.

15. The support device of claim 11, said base having said plurality of legs extending respectively from four corners of said base, each of said plurality of legs having a flat surface opposite said base.

* * * * *